United States Patent [19]

Eisermann

[11] Patent Number: 5,000,018

[45] Date of Patent: Mar. 19, 1991

[54] HARDWARE, IN PARTICULAR FOR DOORS OR THE LIKE

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 431,589

[22] Filed: Nov. 3, 1989

[30] Foreign Application Priority Data

Nov. 8, 1988 [DE] Fed. Rep. of Germany ..... 3837781
May 5, 1989 [DE] Fed. Rep. of Germany ..... 3914751

[51] Int. Cl.[5] ..... E05B 47/00
[52] U.S. Cl. ..... 70/277; 70/223; 70/472

[58] Field of Search ..... 70/276, 277, 278, 279, 70/472, 223;.292/DIG. 27, 144, 201

[56] References Cited

U.S. PATENT DOCUMENTS

| | | | |
|---|---|---|---|
| 4,073,527 | 2/1978 | Schlage | 292/DIG. 27 |
| 4,676,083 | 6/1987 | Sedley | 70/276 |
| 4,854,143 | 8/1989 | Corder | 70/223 |

*Primary Examiner*—Robert L. Wolfe
*Attorney, Agent, or Firm*—Martin A. Farber

[57] ABSTRACT

Hardware, in particular for doors or the like, includes a push pin which can be coupled by key-card insertion with an actuating knob. In order to obtain increased possibilities of use, without reduction of locking security, a coupling is actuatable by means of an electromagnetic device.

17 Claims, 13 Drawing Sheets

HARDWARE, IN PARTICULAR FOR DOORS OR THE LIKE

FIELD AND BACKGROUND OF THE INVENTION

The present invention relates to hardware particularly for doors, or the like, the push pin of which can be coupled to an actuating knob by insertion of a key card.

Such hardware is known, for instance, on hotel doors. By the inserting of a key element from the outside of the door, for instance in the form of a key card which is magnetically coded in regions thereof, the engagement position of the coupling between push pin and actuating handle is produced so that the door can be opened. The opening of the door from the inside, on the other hand, is possible without key actuation.

SUMMARY OF THE INVENTION

The object of the invention is to provide hardware of the type in question which is of increased possibilities of use, in a manner simple to manufacture and without reduction of the security of the locking.

This object is attained by the invention by actuation of a coupling (K) by means of an electromagnetic device (12).

Further advantageous developments of the solution in accordance with the invention are described below and are set forth in the claims.

As a result of this development, there is provided hardware of the type in question which is characterized by an increased range of use. On the one hand, the hardware can be actuated in customary manner by a magnetically coded key-card, a suitable key or a correspondingly developed locking element. On the other hand, however, remote control by which the push pin can be coupled to the actuating handle is also possible. Therefore, the hardware is also suitable for use in locking systems which are to permit individual and/or also the remote-controlled opening of a door. It is possible to provide the hardware on house doors or on doors of doctors' offices. In the latter case, the hardware can be set for daytime operation by remote control so that entrance into the doctor's office is possible at any time during office hours. The change to nighttime operation then leads to disconnection, so that introduction of the required key element or of the magnetically coded key card is necessary.

Since both the key-actuated device and electromagnetically actuated device act on the same coupling, the hardware can be constructed simply, with the saving of structural parts. The provision of two oppositely operating electromagnetic devices, each of which can be controlled individually, affords the advantage of further possibilities of locking. The one electromagnetic device replaces the coupling by a key card while the other then eliminates it. The latter is actuated when individual entrance by the magnetic card is to be prevented. Moreover, this other electromagnetic device is of such a nature that it so supports the actuating member that despite proper insertion of the key and actuation of the corresponding device, the coupling position cannot be brought about. This exclusion takes place also via a central station from which the one electromagnetically controlled device is also controlled.

The common element on which the key-actuatable device as well as the electromagnetic device operate is thus the toothed coupling bushing, which is displaceable against spring pressure. Upon key or electromagnetic action it is shifted in axial direction, it coming into engagement with a toothing on the actuation-handle side. In this way, by turning the actuating handle, the bolt can be closed and the door opened. The coupling bushing is so developed that the actuating members of the key-actuatable device and of the one electromagnetic device act on its annular collar. In this case there is a free passage in the manner that the uncontrolled actuating member permits displacement of the coupling bushing by means of the other actuating member. In a simple manner of manufacture, the actuating members are developed as leaf-spring tongues the free fork-shaped ends of which cooperate with the annular collar. The latter is of such a nature that each leaf-spring tongue acts approximately on one-half of the ring collar in such a way that the leaf-spring tongues do not overlap and thus interfere with each other. Assurance is always had that the coupling bushing therefore can be brought into the coupling position by means of the one, as well as the other, leaf-spring tongue.

A high degree of security is obtained if the key-actuatable device is a magnetic card lock. By inserting the magnetic card into the magnetic-card lock, such an alignment of the magnetic tumblers takes place that displacement of the coupling bushing via the leaf-spring tongue into the position of engagement is then possible. In order to displace the coupling bushing by means of the one electromagnetic device, an armature is provided which is surrounded by a coil and cooperates with one end of a swingably mounted bell-crank lever the free arm of which acts on the associated actuating member. As soon as the coil has been connected to the electric circuit by remote control, displacement of the armature takes place and, via the bell-crank lever, it brings the associated actuating member into the corresponding position, namely into the engagement position or the release position. In order that the armature remains stationary both in the one position and the other without the coil having to be further acted on by current, the end of the armature facing away from the bell-crank lever cooperates with a yoke which is energized by a permanent magnet. The control of the armature is preferably such that the armature is attracted by the yoke when the engaged position of the actuating member of the electromagnetic device is present. The attracting of the yoke takes place by the action of the permanent magnet. Its action is eliminated when the coil is traversed by current. This takes place by the superimposing of the electromagnetic field on the permanent-magnet field. The arrangement is preferably such that the coil can be connected for its energization via a pole-reversal switch to a capacitor which is charged by means of a source of voltage.

This development has the advantage that, even in the case of different sources of voltage (with output voltages which vary within a certain range), or upon the use of batteries which—depending upon length of use—may show a different state of charge, an electromagnetic displacement of the armature nevertheless definitely takes place. This results from the fact that the charged capacitor, due to its low internal resistance, is able to supply a high current pulse which results in a corresponding excitation of the magnetic coils so that the displacement of the armature—against the action of the permanent magnet—is assured. Furthermore, the parallel connection of the capacitor to the coil affords the possibility of a capacitor charge which is still sufficient to permit an actuation of the electromagnetic device within a certain period of time in case of failure of the source of voltage.

Preferably, in this connection, the position of the actuating member corresponding to the one electromagnetic device can be electrically interrogated by means of a feeler. In this way, the state of operation of the lock can be recognized. Preferably, it is possible by means of the feeler to control light-emitting diodes so that a verification is possible at all times from a control booth or the like. It is possible for an other electromagnetic device to act on the actuating member associated with the key-actuatable device. As soon as this takes place, no coupling can be produced any longer via the key-actuatable device. On the one hand, it is possible to develop the other electromagnetic device as a coil arrangement with armature which acts on the actuating member.

A more favorable development from a standpoint of force resides therein that in the axial extension of the one electromagnetic device, in the direction facing away from a push pin, the other electromagnetic device has a coil arrangement the armature of which is pivotally coupled with the one end of a transmission rod the other end of which acts on a single-arm press lever which can be moved into the region of movement of the actuating member which is associated with the key-actuatable device. Therefore, an amply dimensioned coil arrangement can be used without the structural height of the hardware being increased.

In this case also, an arrangement can be used such that when the actuating member is acted on, the key-actuatable device of the armature of the coil arrangement of the other electromagnetic device is attracted by the permanent magnet, so that flow of current is not continuously present, thus saving the source of energy. The double-layer development of the push lever, the two layers of which are connected by a bridge which extends closely below the coupling bushing attains to a favorable action of force on the key-actuatable actuating member. Therefore, the corresponding actuating member is struck on the outer end, obtaining favorable lever ratios. Clearly viewed construction and facilitated assembly result from the fact that the housing receiving the one electromagnetic device is developed lengthened and the coil arrangement of the other electromagnetic device is arranged in the lengthened section. To this there also contributes the fact that the transmission rod extends along the one side flank of the housing.

Finally, a development in accordance with the invention also contains a time-switch device which, within a predetermined period of time, eliminates the engaged position of the coupling by control of one electromagnetic device. In this way a so-called "timer" is created which is of such a construction that the door must be opened within a certain period of time after connection of the electromagnetic unit, for instance 5 or 10 seconds. After this, the one electromagnetic device is controlled by the time-switch device so as to bring the coupling into the release position.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIG. 5 is a rear view of the hardware outer plate with the housing cover placed on;

DETAILED DESCRIPTION OF THE PREFERRED EMBODIMENTS

Figure 1:
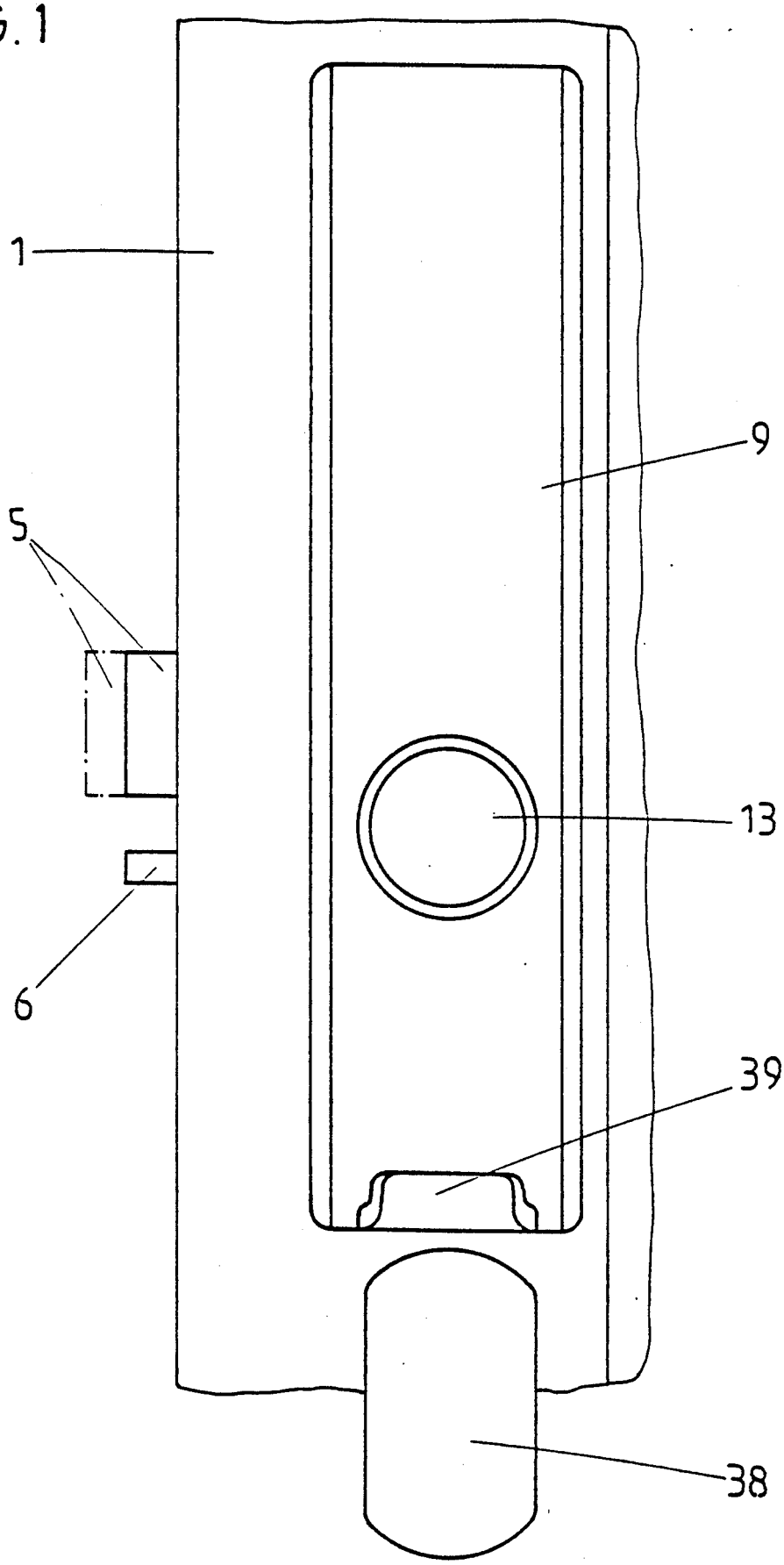
FIG. 1 is a partial section through a door provided with the hardware of the invention, looking at the hardware outer plate in accordance with the open position of the door, in the case of the first embodiment.
Figure 2:
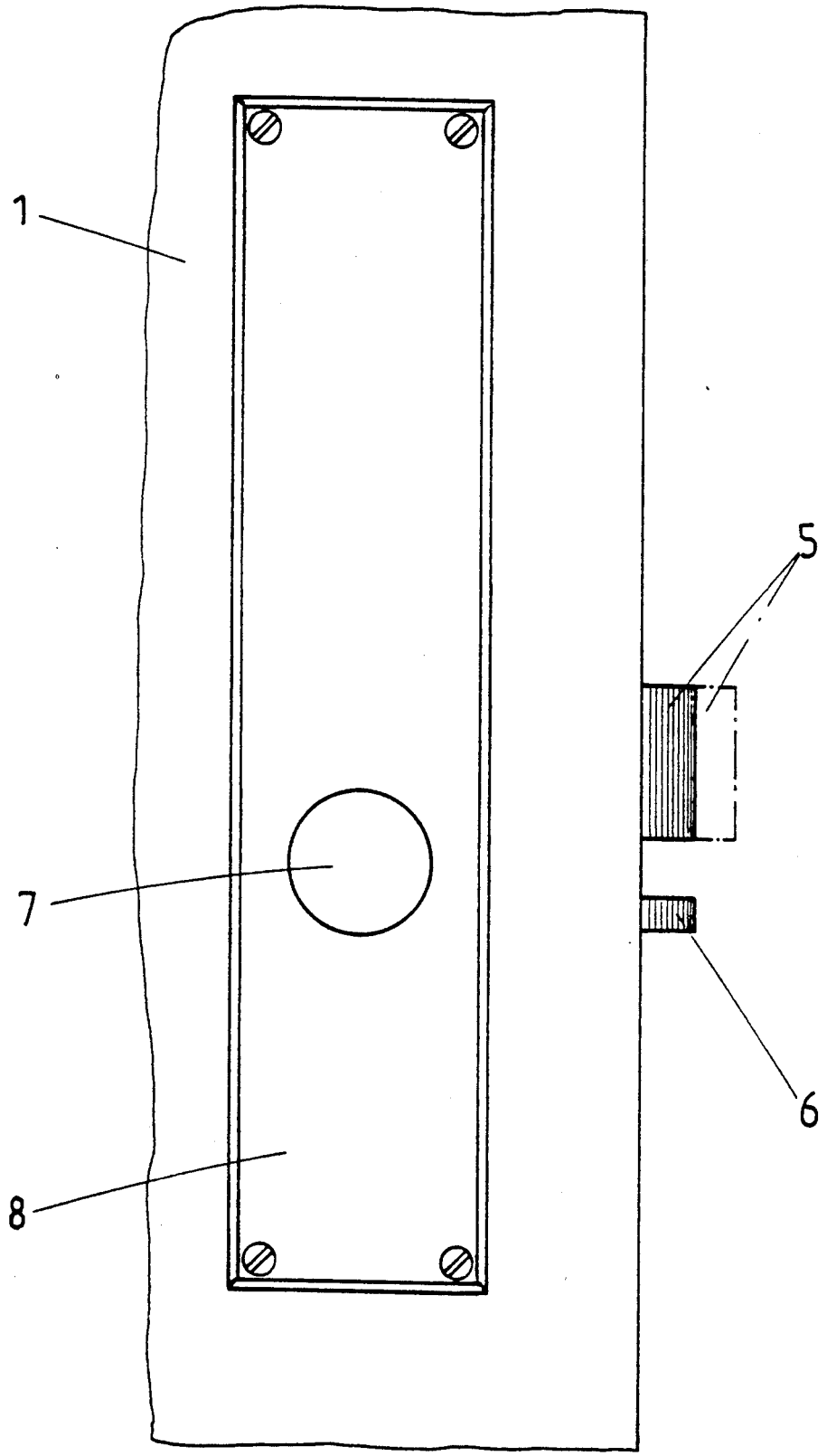
FIG. 2 is a corresponding inside view of the door, looking at the hardware inner plate, also with the door open.
Figure 3:
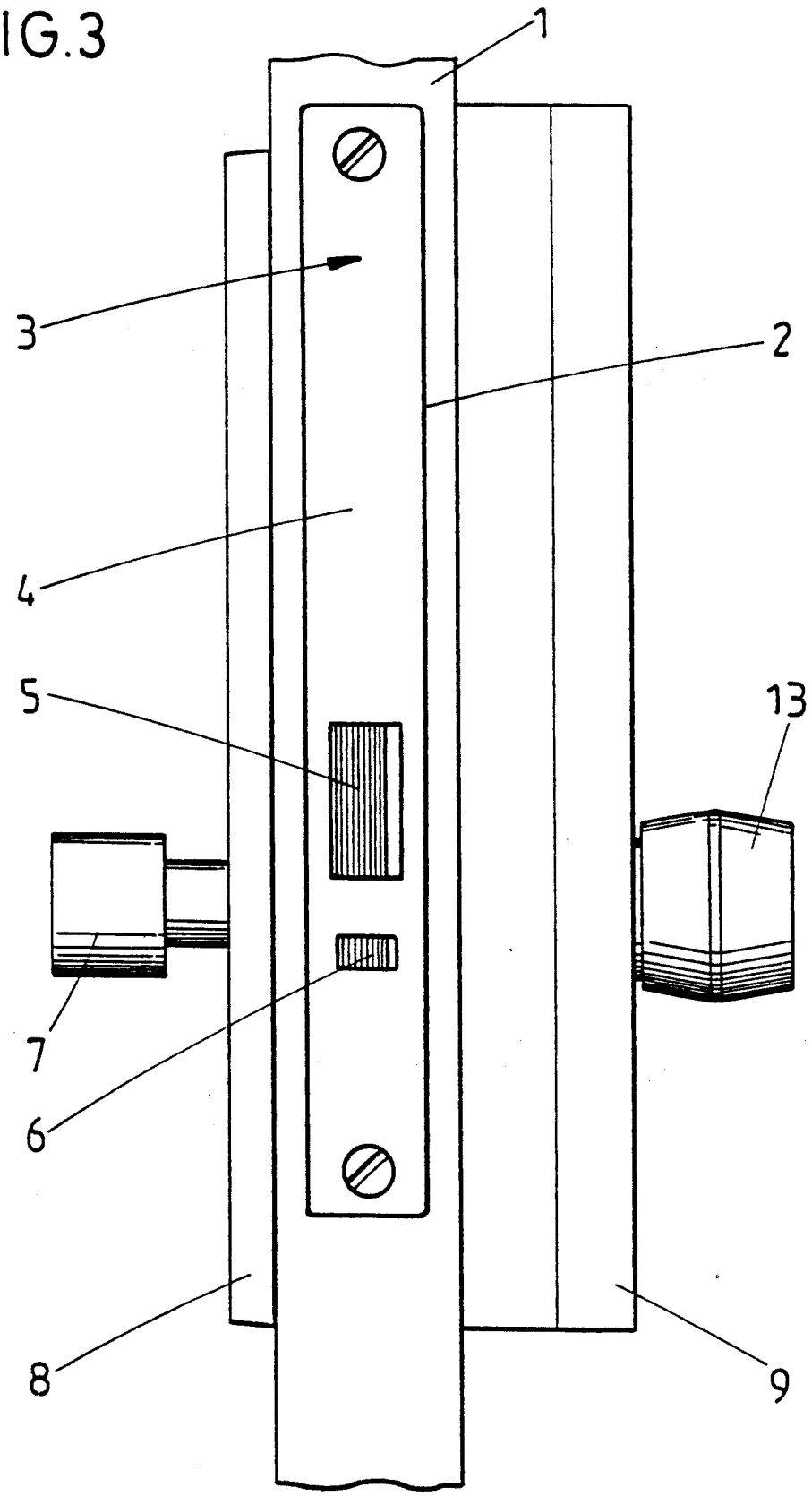
FIG. 3 is a stop-side view of the door.
Figure 4:
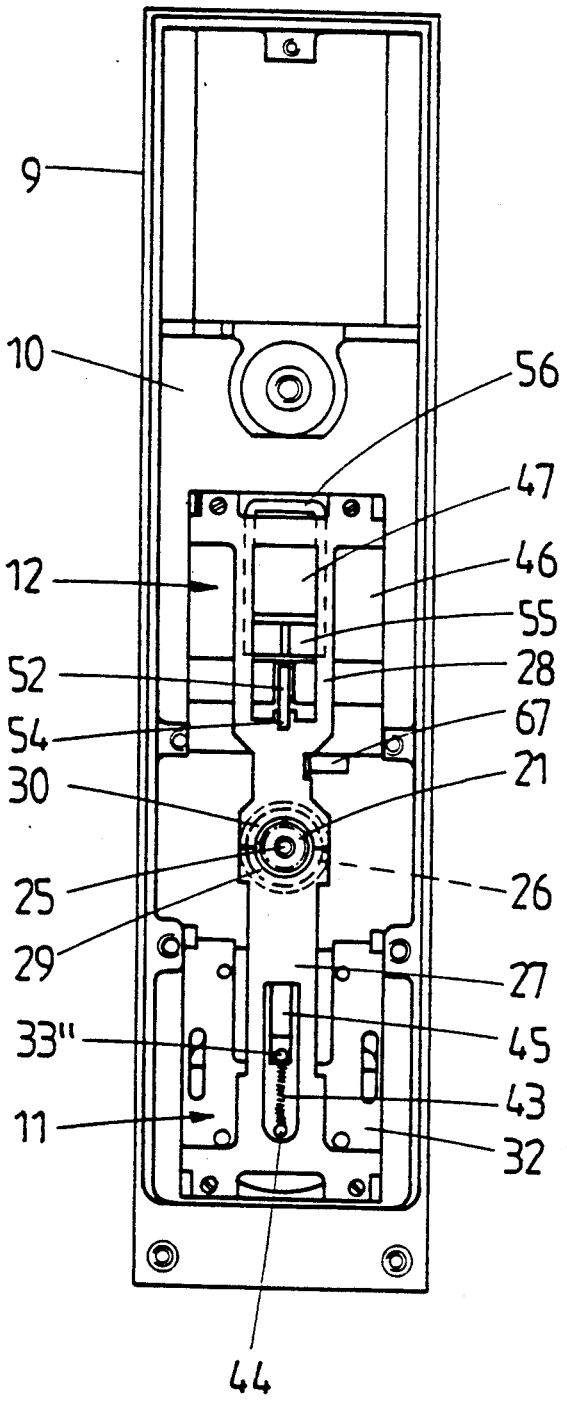
FIG. 4 is an inner view of the hardware outer plate, looking at the key-actuatable and electromagnetically actuatable device.
Figure 5:
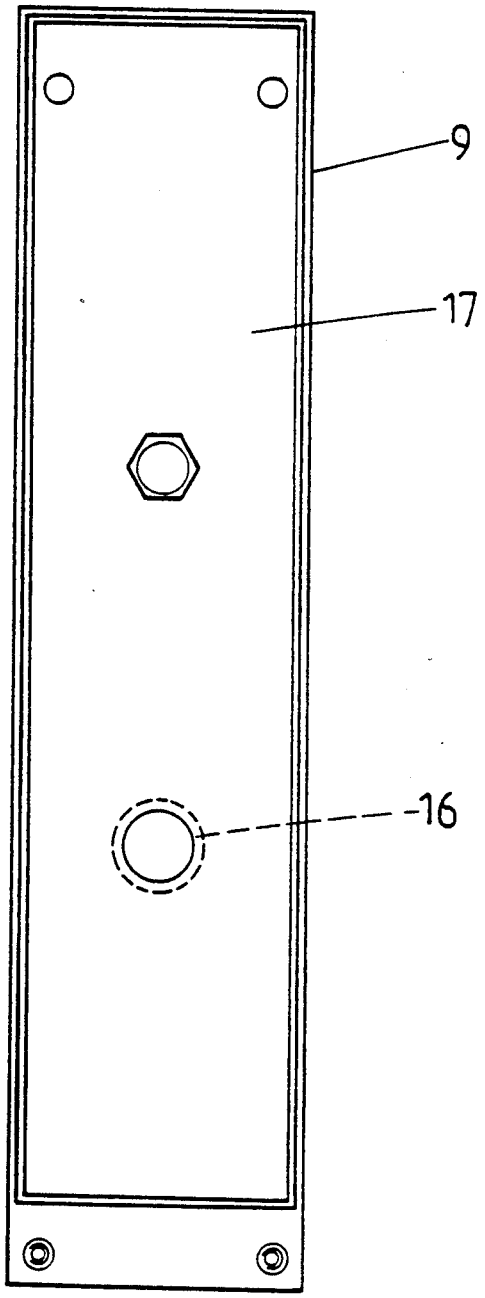

In accordance with the first embodiment of the hardware which is shown in FIGS. 1 to 10, 1 is a door which receives a mortise lock 3 and a lock pocket 2 extending from the stop side. Its stop plate 4 is passed through by a drop latch 5 and by a control latch 6 which extends below the drop latch 5. When the door is open, the drop latch 5 extends over the stop plate 4 by the amount shown in solid line in FIGS. 1 and 2. If the door is closed, then the drop latch 5 and the control latch 6 first of all move toward the inside of the lock. As soon as the drop latch 5 is aligned with the corresponding engagement opening of a frame-side mating lock part, the drop latch 5 can move rapidly into the position shown in dot-dash line, with the blocking of the door.

A press nut (not shown) of the mortise lock 3 is continuously coupled with an inner turn knob 7. By means of it, with the door closed, the drop latch 5 can be drawn back completely in order to be able to open the door 1. The inner turn knob 7 is mounted in an elongated rectangularly shaped housing inner plate 8.

Opposite the hardware inner plate 8, a hardware outer plate 9 is fastened to the outer side of the door. The outer plate has a stop-side recess 10 in which, below the push-pin shaft (A—A), there is provided a key-actuatable device indicated generally as 11. Above the axis A—A, on the other hand, there is another magnetically actuatable device 12. Both of the latter operate on the coupling designated K between an actuating knob 13 on the outside of the door and the drop latch 5.

The coupling K has a push pin 14 of square cross-section which passes through the push nut (not shown) and is in formlock engagement with the inside turn knob 7. Adjoining the push pin 14, there is a collar 15 of circular cross-section. This collar 15 is mounted in a bushing 16 in the housing cover 17 which extends over the recess 10. For axial securing against the pulling out of the push pin 14, there is provided an annular flange 18 which rests on the inner side against said bushing 16. Adjoining the annular flange 18 there is, integral with it, an externally toothed sleeve 19 which terminates in front of an end of a toothed bushing 20. The outer toothing of the latter corresponds to that of the sleeve 19. The toothed bushing 20 is, in its turn, connected, fixed-for-rotation, with the actuating knob 13 on the outside of the door. A coupling bushing 21 is displaceable axially on the sleeve 19. Said coupling bushing has an inner toothing which fits the outer toothing of the sleeve 19 and of the toothed bushing 20. The coupling bushing 21 is brought into its released position by a coil compression spring 22 which surrounds the coupling bushing 21 and acts on it against an annular shoulder 23. The other support of the coil compression spring 22 is in the vicinity of the bottom 24 of the hardware plate 9. In the release position of the coupling bushing 21, the latter rests against the annular flange 18. This is the position in which exclusively the coupling engagement between coupling bushing 21 and sleeve 19 is present. In order that there is always a precise axial alignment of sleeve 19 and toothed bushing 20, the two of them are passed through by a centering pin 25.

Near its end surface facing the annular flange 18, the coupling bushing 21 has an annular collar 26, against which actuating members 26, 27, 28 of the key-actuatable device 11 and of the electromagnetic device 12 act. Both actuating members 27, 28 are developed as leaf-spring tongues the free fork-shaped ends 29, 30 of which cooperate with the annular collar 26, resting against the latter. The application is such that each of the ends 29, 30 acts on half of the annular collar 26. The axial load acting on the coupling bushing 21 is so selected that when the devices 11, 12 are not actuated it does not pass into engaged position with the toothing of the toothed bushing 20. The actuating knob 13 on the outside of the door can then be turned freely so that the opening of the door 1 is not possible.

The key-actuatable device 11 inserted from the rear of the hardware outer plate 9 has a bottom plate 31 and a cover 32 extending parallel thereto, which parts are held spaced from each other by webs, not shown in detail. Both the cover 32 and the bottom plate 31 consist of aluminum. A slide 33 which extends in the longitudinal direction of the outer plate 8 of the door slides along the bottom of the cover. The slide consists of plastic and is of plate shape. The guide surface facing the cover 32 is formed by a blocking plate 34 of brass which is inserted into the housing from the cover side and is held immovably there. Holes 35 provided in the blocking plate 34 are aligned in the locking position of the slide 33 shown in FIG. 6 with corresponding mounting recesses 36 of the slide. The recesses are developed as continuous holes and receive magnet pins 37 which engage into the blocking-plate holes 35. A plurality of such mounting recesses 36 are provided in the slide 33. However, it is not necessary to arrange a magnet pin in each mounting recess since the number, position and polarization of the magnet pins 37 depends on a correspondingly shaped magnetic key. The latter is developed as a card key 38 of suitable stiffness which is magnetized in a region thereof and can be inserted from an insertion shaft 39 extending from the bottom side of the hardware plate.

On the blocking plate 34, there rests a copper guide plate 40, the wide surface of which facing the blocking plate 34 is located at the height of the aforementioned insertion shaft 39. On the corresponding wide surface, there rests an armature plate 41 which is held in position by a leaf-spring 42. The armature plate 41, in contradistinction to the other structural parts of the key-actuatable device 11, consists of ferromagnetic material. The armature plate 41 thus attracts the magnet pins 37, as a result of which they engage into the holes 35 in the blocking plate 34. In this position of the magnet pins, the slide 33 cannot be pushed out of its basic position shown in FIG. 6, since the engagement of the magnet pins 37 into the blocking plate 34, which is fastened to the housing, prevents this.

A tension spring 43 which serves as return spring, has its one end fastened to a transverse pin 44 of the cover 32. The other end of the tension spring 43 acts on a projection 33″ of the slide 33.

Furthermore, the slide 33 forms a control projection 45 which passes through an opening in the actuating member 27 and by means of which displacement of the actuating member 27 fastened to the device 11 is possible in the direction of the coupling bushing 21 in order to displace the latter.

The electromagnetic device 12 also comprises a housing 46 which is inserted in the recess 10 in the door outer plate 9 and fastened there. This housing bears, opposite the actuating element 27, the actuating element 28 the end 30 of which engages, in opposite position to the end 29, on the coupling bushing 21. For the displacement of the actuating member 28 in the direction toward the coupling bushing 21 there is provided a pin-shaped armature 48 which passes through a coil 47. This armature is of circular cross-section. The outward end of the armature 48 is provided with a slot 49 which is closed on its end by a transverse pin 50. The one end 51 of a bell-crank lever 52 engages into the opening which is thus formed. A pin 53 of the housing 46 forms the pivot point for the lever. The free bell-crank lever arm 54 passes through the actuating member 28 and rests against its outer side. The end of the armature 48 facing away from the bell-crank lever 52 cooperates with a yoke 56 which is energized by a permanent magnet 55. The yoke 56 is of U-shape and surrounds the coil 47.

Figure 10:
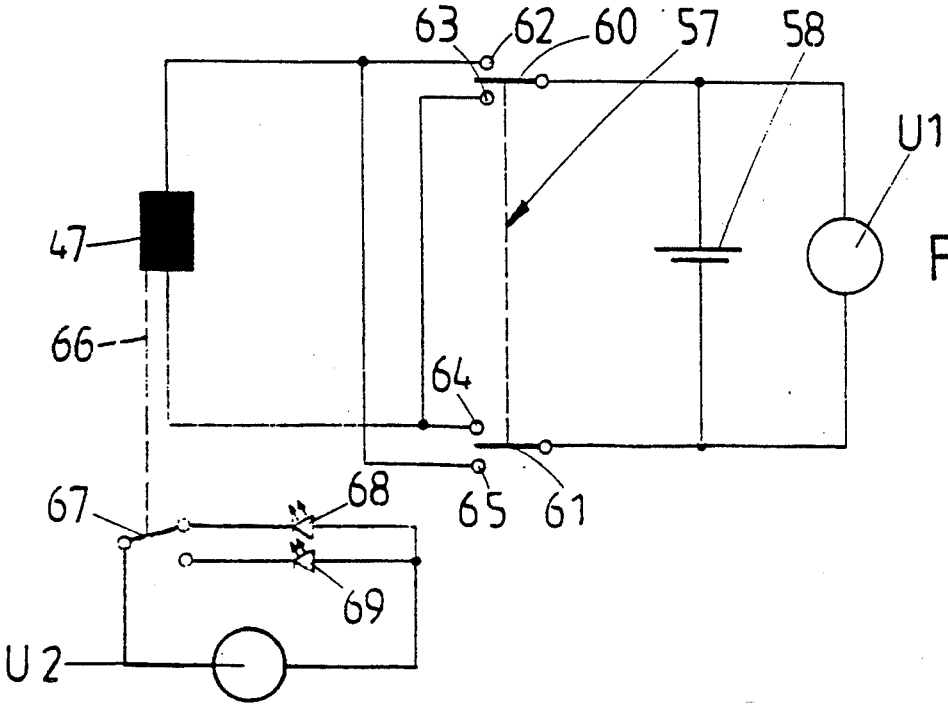
FIG. 10 is a wiring diagram of the electromagnetic device.
Figure 11:
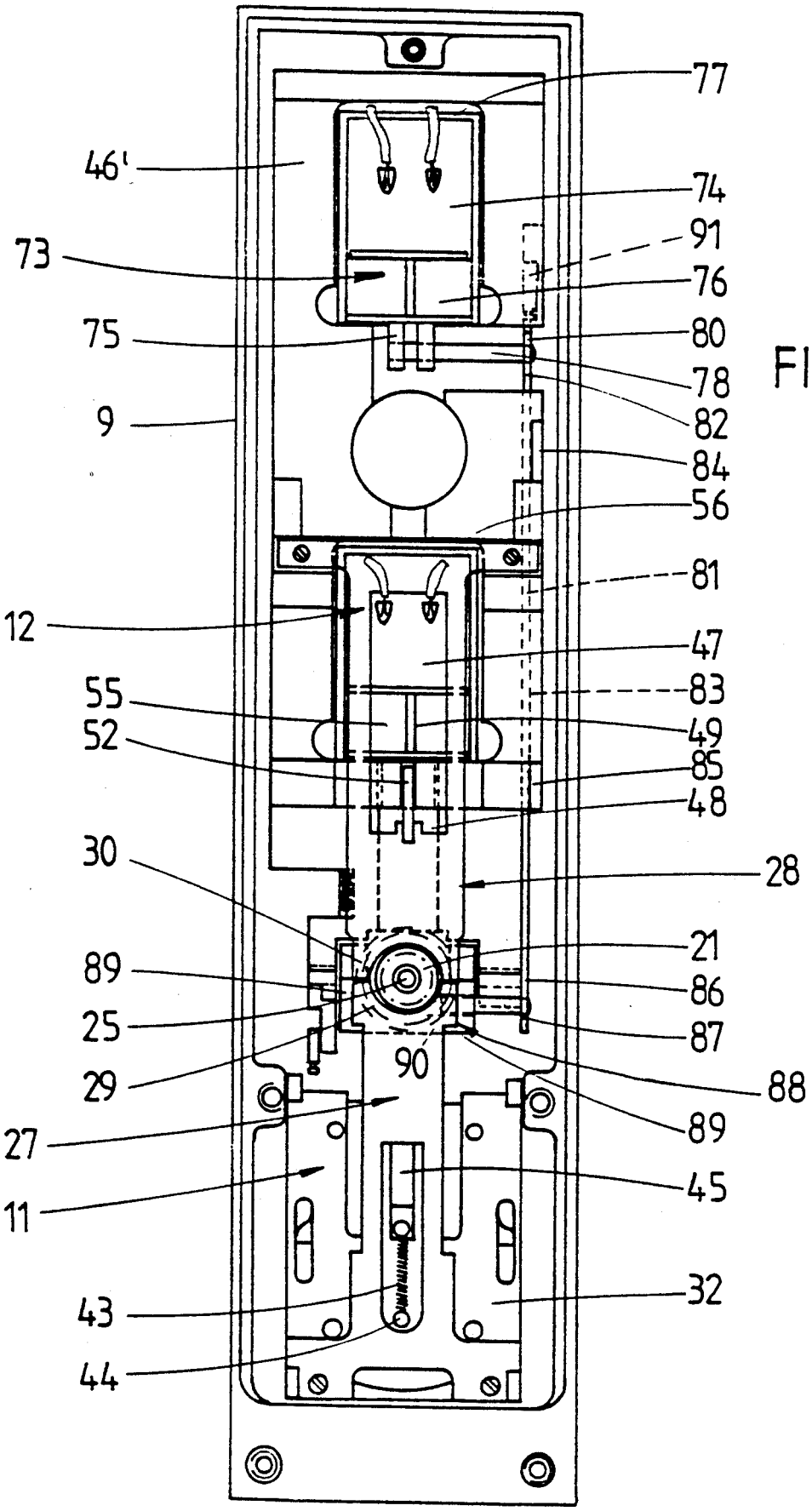
FIG. 11 is an inner view of the hardware outer plate, looking at the key-actuated device and the two electromagnetic devices, in the case of the second embodiment.
Figure 12:
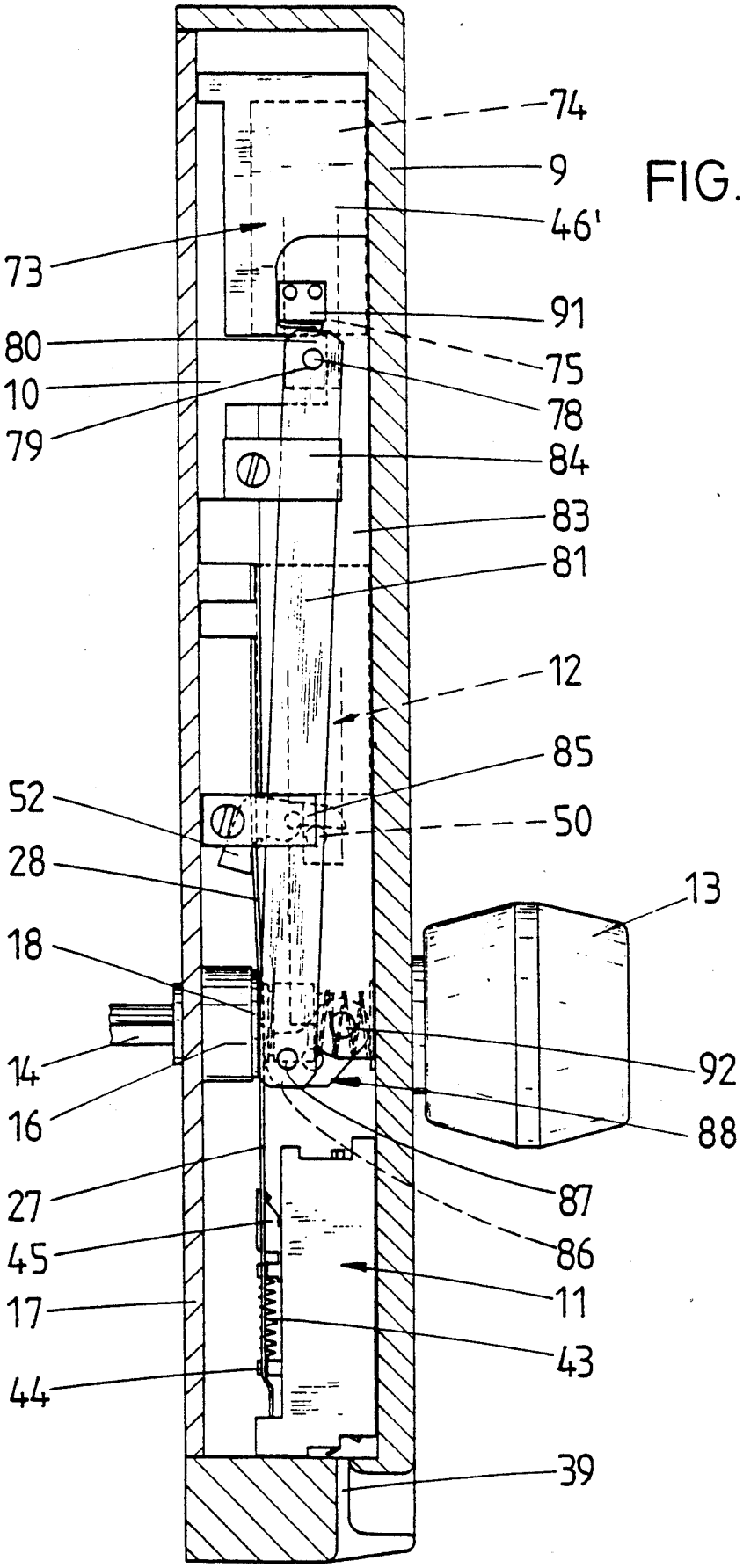
FIG. 12 is a vertical section through the hardware outer plate, looking at the housing containing the two electromagnetic devices, the coupling produced by the key card being eliminated by the other electromagnetic device.
Figure 13:
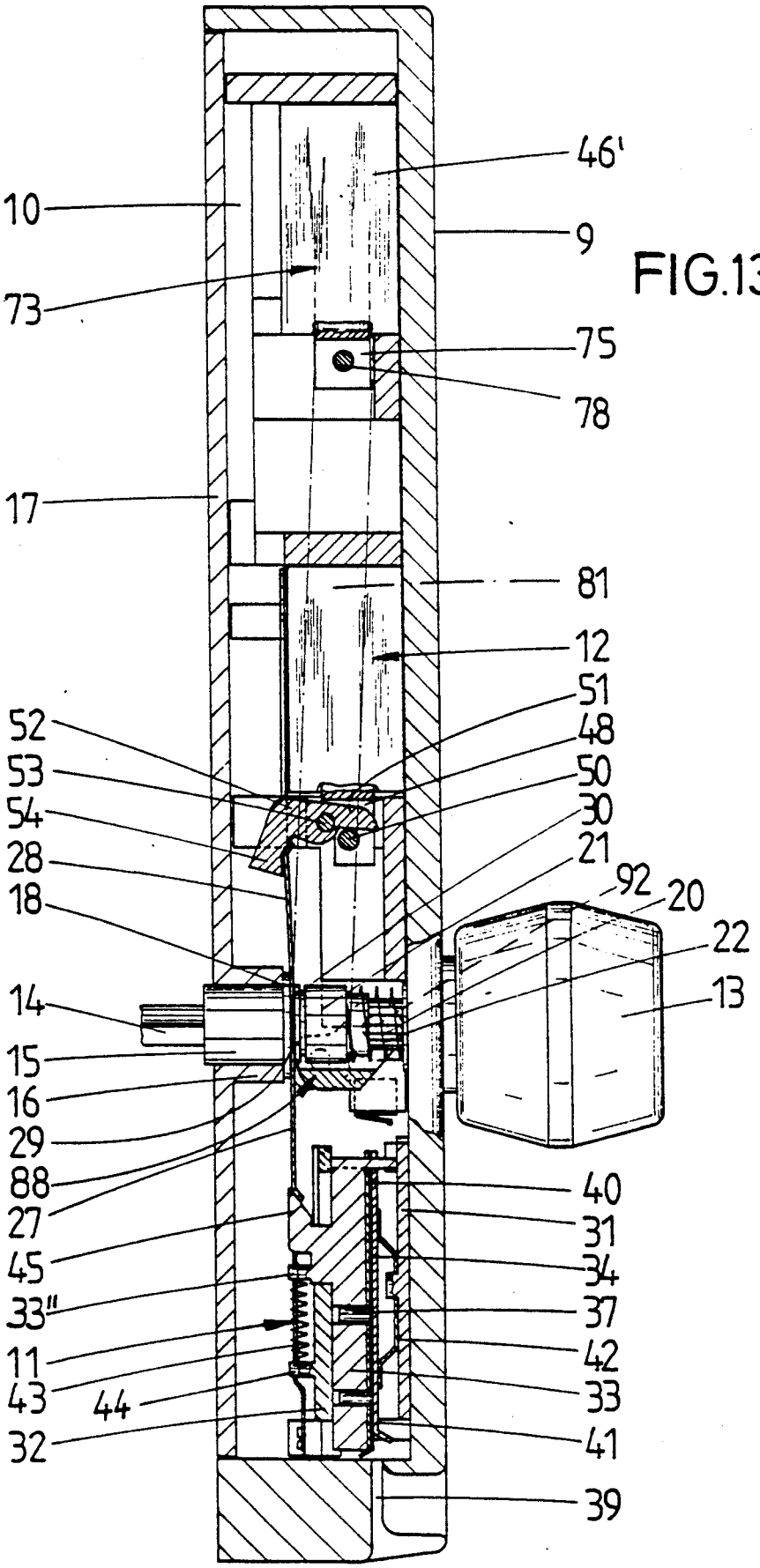
FIG. 13 is a corresponding central longitudinal section through the hardware outer plate and the devices.

In accordance with the wiring diagram shown in FIG. 10, the coil 47 can be connected for its excitation to a capacitor 58 via a pole-reversal switch 57. A source of voltage U1 is present in parallel with the capacitor 58. This voltage source can be developed as a power pack; as an alternative, or in addition, it is however also possible to employ a dry-cell or storage battery here. The two terminals of the capacitor 58 lead to the corresponding switch contact 60, 61 of the pole-reversal switch 57, which is developed as a double-reversal switch. The switch contact 60 in its rest position is in the position shown in FIG. 10, i.e., it is connected neither with a mating contact 62 nor 63. The same applies to the switch contact 61 which can cooperate with the mating contacts 64 and 65. The mating contact 62 leads to the coil 47, and the other end of the coil 47 is connected to the mating contact 64. The mating contact 63 is connected to the mating contact 64 and the mating contact 65 is connected to the mating contact 62. A functional connection 66, shown in dash-line, leads to a feeler 67 which is developed as change-over switch. The terminals of the feeler 67 are connected to light-emitting diodes 68 and 69, respectively. A source of voltage U2 is provided for the operation of the light-emitting diodes 68 and 69. A single source of voltage can also preferably be provided for the lock, so that U1 is then equal to U2. The functional connection 66 has the following mechanical construction: The feeler 67 is in functional connection via a feeler member with the actuating member 28; i.e., the feeler 67 responds or does not respond depending on the position of the actuating member. The corresponding positions are indicated by the light-emitting diodes 68 and 69, which corresponds to the "uncoupled" or "coupled" condition of the coupling sleeve 21.

The following manner of operation is obtained:

If the pole-reversal switch 57 is so actuated that its switch contacts 60 and 61 are connected to the mating contacts 62 and 64, then the capacitor 58 gives off essentially a current pulse (the voltage source U1 acts merely as support), as a result of which the coil 47 is energized and the armature 48 is attracted to the yoke 56. The armature 48 is held in this position due to the action of the permanent magnet 55. Upon the displacement of the armature 48, a swinging of the bell-crank lever 52 takes place so that it leaves the position shown in FIG. 7 and assumes the position shown in FIG. 9. In this connection, the free angle arm 54 carries along the actuating member 28 so that the coupling bushing 21 passes, against the force of the compression spring 22, into engaged position with the toothed bushing 20. In this way, the rotary connection is established between the acting knob 13 on the outside of the door and the drop latch 5. The door can thus be opened. For the actuation of the pole-reversal switch 27, merely a brief pressing is necessary since after the giving off of a current pulse, the switch contacts 60 and 61 come back into the position shown in FIG. 10. Nevertheless, in this return position the armature 48—as already described—remains in the position which it had previously assumed, since it is held by permanent magnetic force.

If the door is to be locked, it is necessary for the coupling bushing 21 to come out of engagement with the toothed bushing 20. Accordingly, action on the actuating knob on the outside of the door cannot have any effect. This condition is brought about in the manner that, once again, the pole-reversal switch 57 is actuated, namely in such a manner that its switch contacts 60 and 61 are brought into contact with the mating contacts 63 and 65. In this way, a current-pulse reversal occurs, i.e., the coil 47 is energized with the reverse polarity—opposite the previous operation—so that an oppositely directed electromagnetic field is built up. This electromagnetic field cancels out the permanent-magnetic field of the permanent magnet 55 and furthermore—due to the oppositely directed flow of current in the coil 47—displaces the armature 48 away from the yoke 56, as a result of which the bell-crank lever 54 is so swung that its free angle arm 52 releases the spring-action actuating member 28. In this way, the coupling bushing 21, as a result of its spring load, passes into release position, i.e., the toothed engagement to the toothed bushing 20 is eliminated.

The displacement of the actuating member 28 described above results in an actuation of the feeler 67 so that the light-emitting diode 68 is traversed by current in the one position and the light-emitting diode 69 in the other position.

The construction of the circuit described above has the advantage that the coil 47 need not be permanently traversed by current in the two operating positions of the lock; rather it is sufficient to cause a switching by a short current pulse. In this way, the source of current is protected, which is particularly of advantage when using batteries. There is furthermore the advantage that, upon failure of a source of voltage, the capacitor 58 for a certain period of time still maintains a sufficient charge in order to be able to effect another actuation of the lock. If it is desired to take the last-mentioned case into consideration, it is advantageous to use different voltage sources U1 and U2 in order to prevent the light-emitting diodes 68 or 69 from discharging the capacitor upon battery failure.

The remotely controllable coupling has been described above. The coupling bushing 21 can also be displaced by the key-actuatable device 11. For this purpose, the key card 38 is inserted into the insertion shaft 39. The key card 38 passes in this connection between the guide plate 40 and the armature plate 41, the latter being displaced in transverse direction against the load by the leaf spring 42. In the completely inserted position, the key card 38 comes with its insertion-side edge in front of a driver projection 33' which extends in the transverse direction of the slide 33. The magnet pins 37 are then so displaced by the magnetized region of the key card 38 that they leave the holes of the locking plate 34. Upon the subsequent further movement of the key card 38, the slide 33 is carried along in positive manner via the driver projection 33, which, in its turn, via the control projection 45, shifts the actuating member 27 out of the position shown in FIGS. 6 and 7 into the position shown in FIG. 8 and thus displaces the coupling sleeve 21 into position of engagement with the toothed bushing 20. In this way, the drop latch 5 can be moved back from the outside of the door by means of the actuating knob 13. Hand-in-hand with the displacement of the slide 33, the tension spring 43 has also been cocked. In the forward-shifted position, the slide 33 is however blocked against rearward displacement as long as the key card 37 is inserted. Only after a certain movement of withdrawal of the key card is this blocking eliminated so that the tension spring 43 can enter into action and return the slide 33 into the initial position shown in FIG. 6 together with a displacement of the coupling bushing 21 into the release position by the compression spring 22 which is associated with it.

Figure 6:
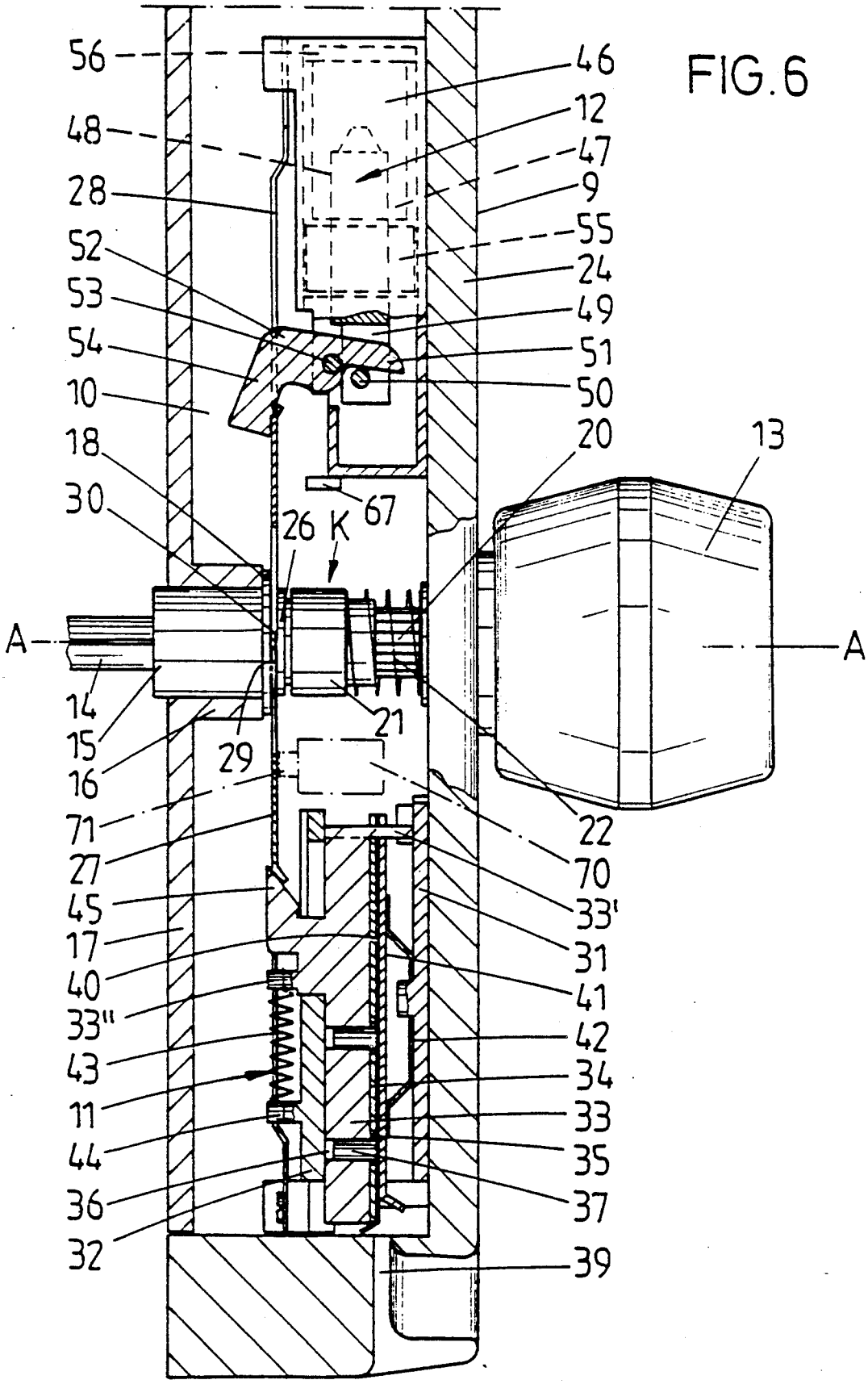
FIG. 6 is a longitudinal section through the hardware outer plate in the region of the two devices acting on the coupling bushing, shown in the release position of the coupling.
Figure 7:
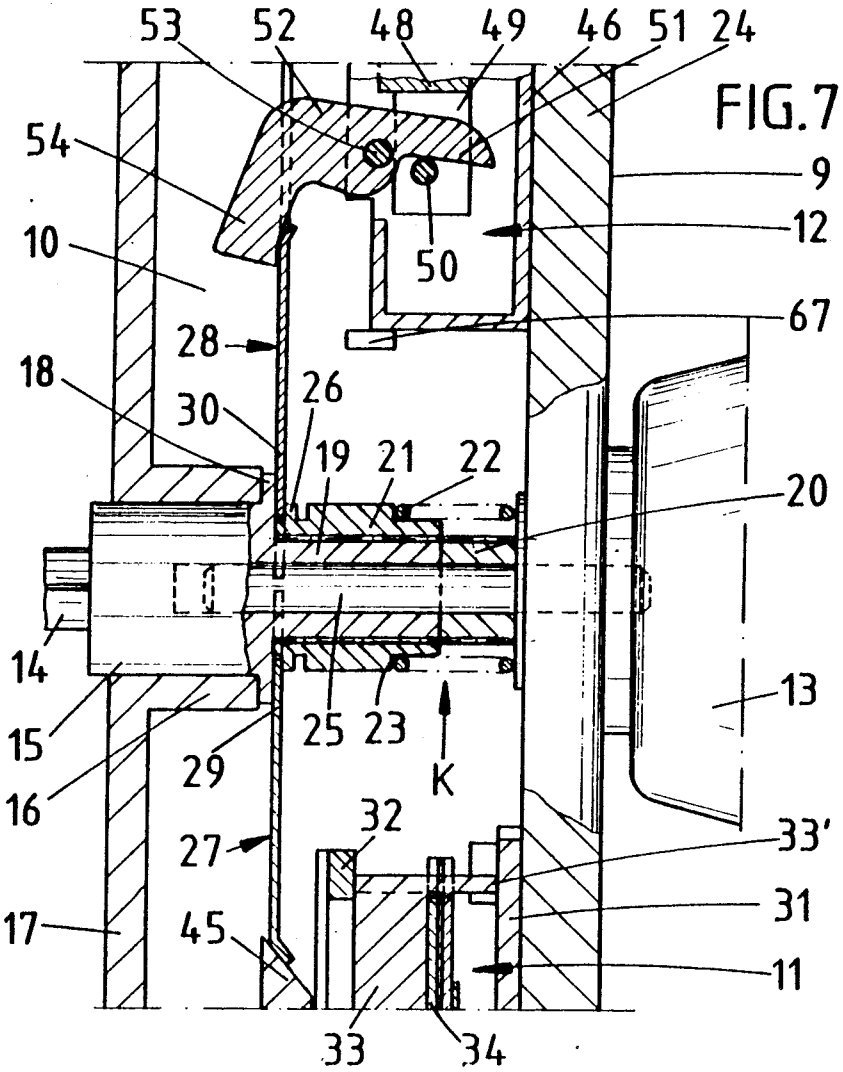
FIG. 7 shows, in an enlarged individual view, a section through the coupling with actuating members acting on the coupling bushing.
Figure 8:
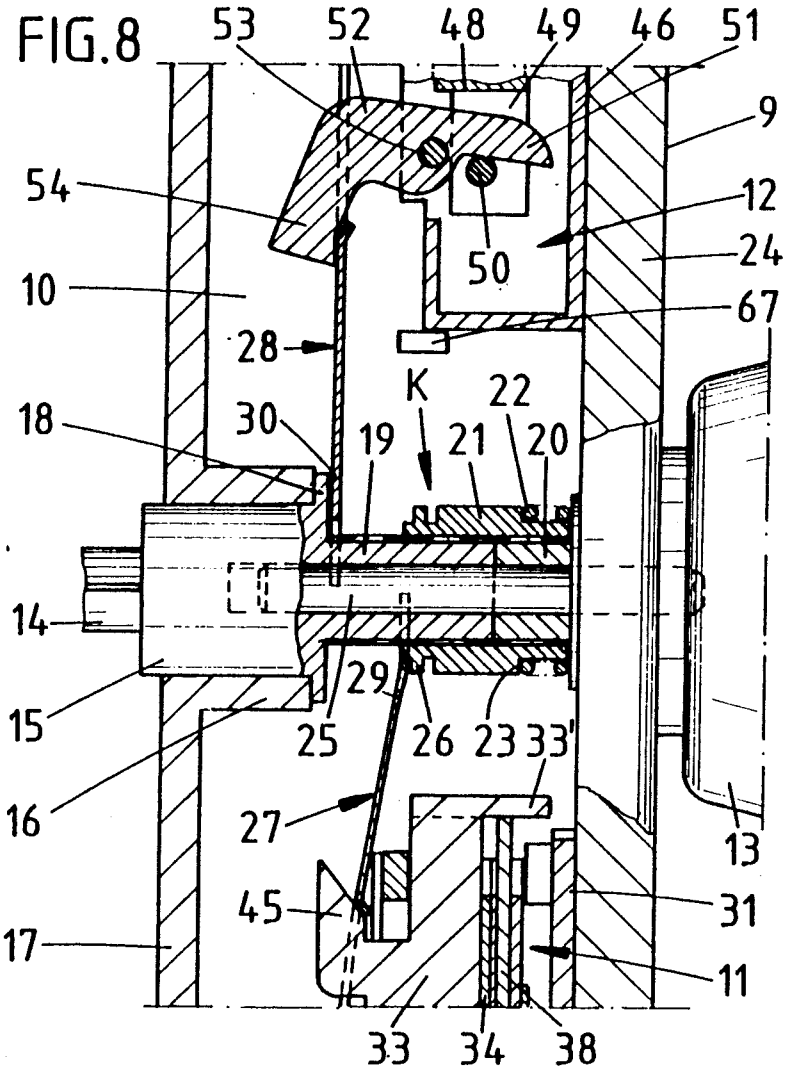
FIG. 8 is a view corresponding to FIG. 7 in which the coupling bushing is engaged by key actuation.
Figure 9:
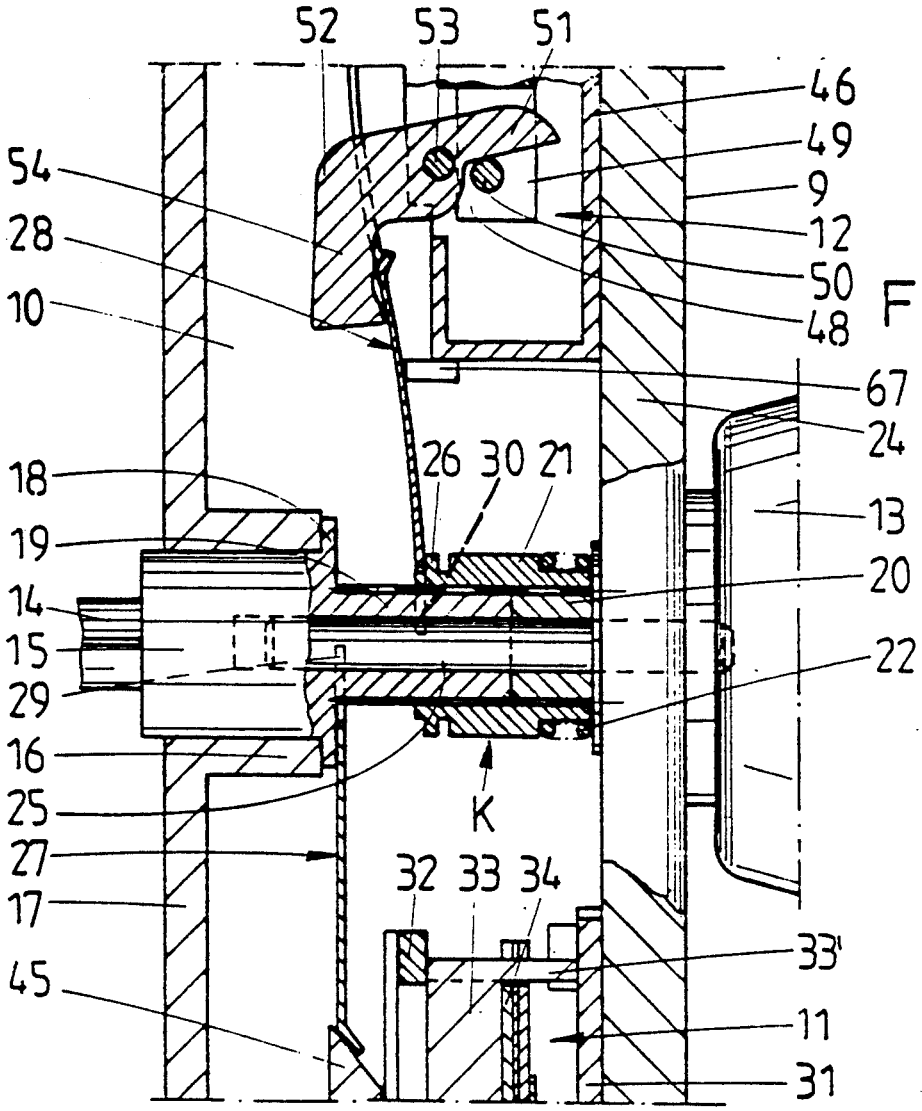
FIG. 9 is also a view corresponding to FIG. 7, in which the displacement of the coupling bushing into engaged position is effected by the electromagnetic device.

FIG. 6 shows, in dash-dot line, that with the one key-actuatable device 11 another electromagnetic device 70 is associated. This electromagnetic device 70 also comprises a coil arrangement with armature 71, which corresponds to the electromagnetic device 12. A permanent magnet as well as a yoke, which are not shown, are also provided. Furthermore, the current pulse takes place via a capacitor. By means of this other electromagnetic device 71 it is possible, by remote operation, to bring the armature 71 associated directly with the actuating member 27 into the position shown in FIG. 6, the armature then supporting the actuating member 27. Therefore, a displacement of the coupling bushing 21 into coupling position is not possible by key actuation. Opening of the door must now be effected by remote control via the electromagnetic device 12. This means that in such a case the key-actuatable device 11 is subordinate to the electromagnetic-operated device 12.

In accordance with the second embodiment, shown in FIGS. 11–16, identical structural parts bear the same reference numbers. The key-actuatable device 11 corresponds in its construction to that of the first embodiment. The same is true of the one electromagnetically-actuatable device 12. The latter is seated in a housing 46' which extends over it. In the portion which extends beyond one electromagnetically actuatable device, the housing 46' receives another electromagnetic device 73. The one electromagnetic device 12 replaces the key-card-produced coupling, while the other 73 eliminates it.

In detail, the other electromagnetic device 73 also comprises a longitudinally displaceable pin-shaped armature 75 which is surrounded by a coil 74 and the lower end of which extends out of the coil 74. The end of the armature 75 opposite said end, on the other hand, cooperates with a yoke 77 energized by a permanent magnet 76. Furthermore, the coil 74 can be connected for its energization via a pole-reversal switch (not shown) to a capacitor which is charged by means of a source of voltage, so that the coil 74 need not be continuously traversed by current in the two operating positions of the device 73.

Figure 14:
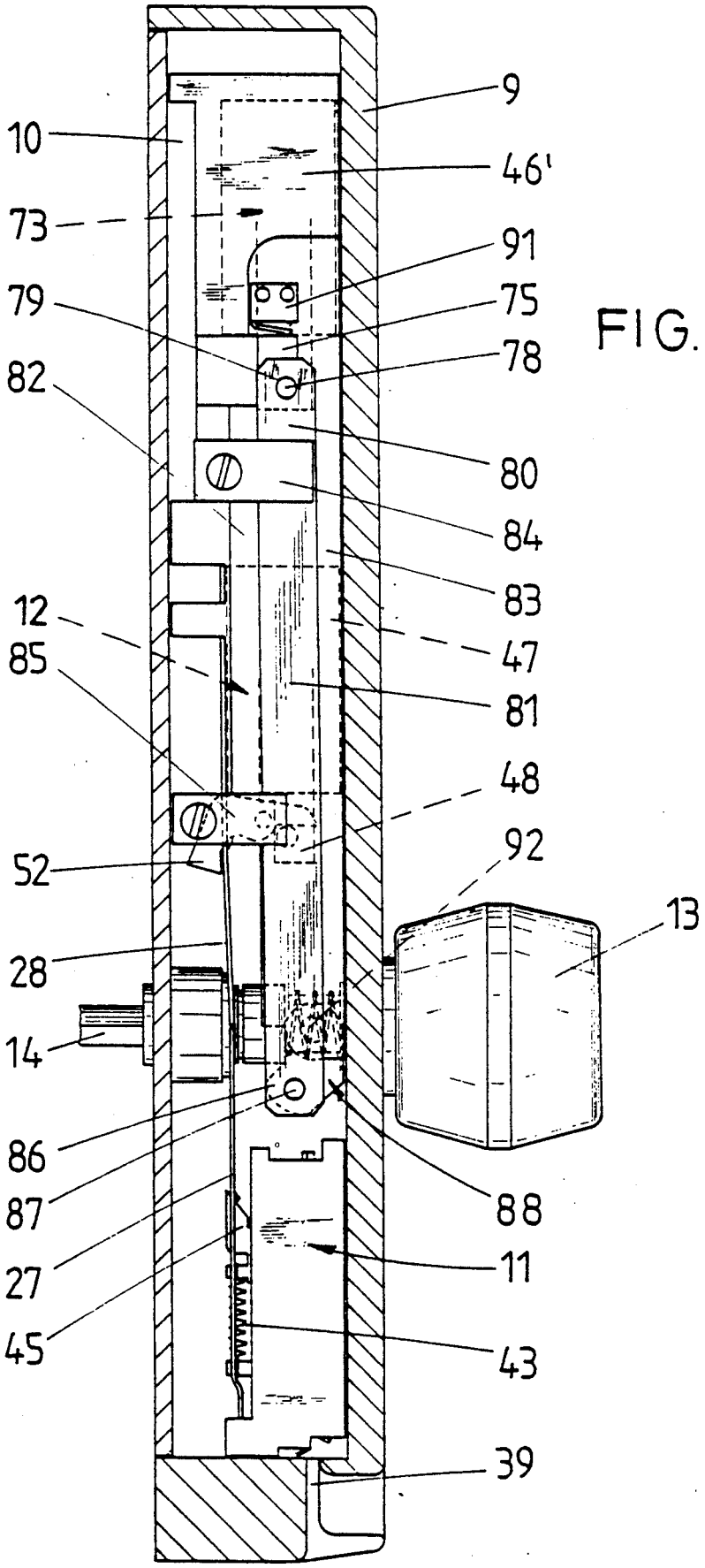
FIG. 14 is a showing, corresponding to FIG. 12, in which the other electromagnetic device has entered into the released position.
Figure 15:
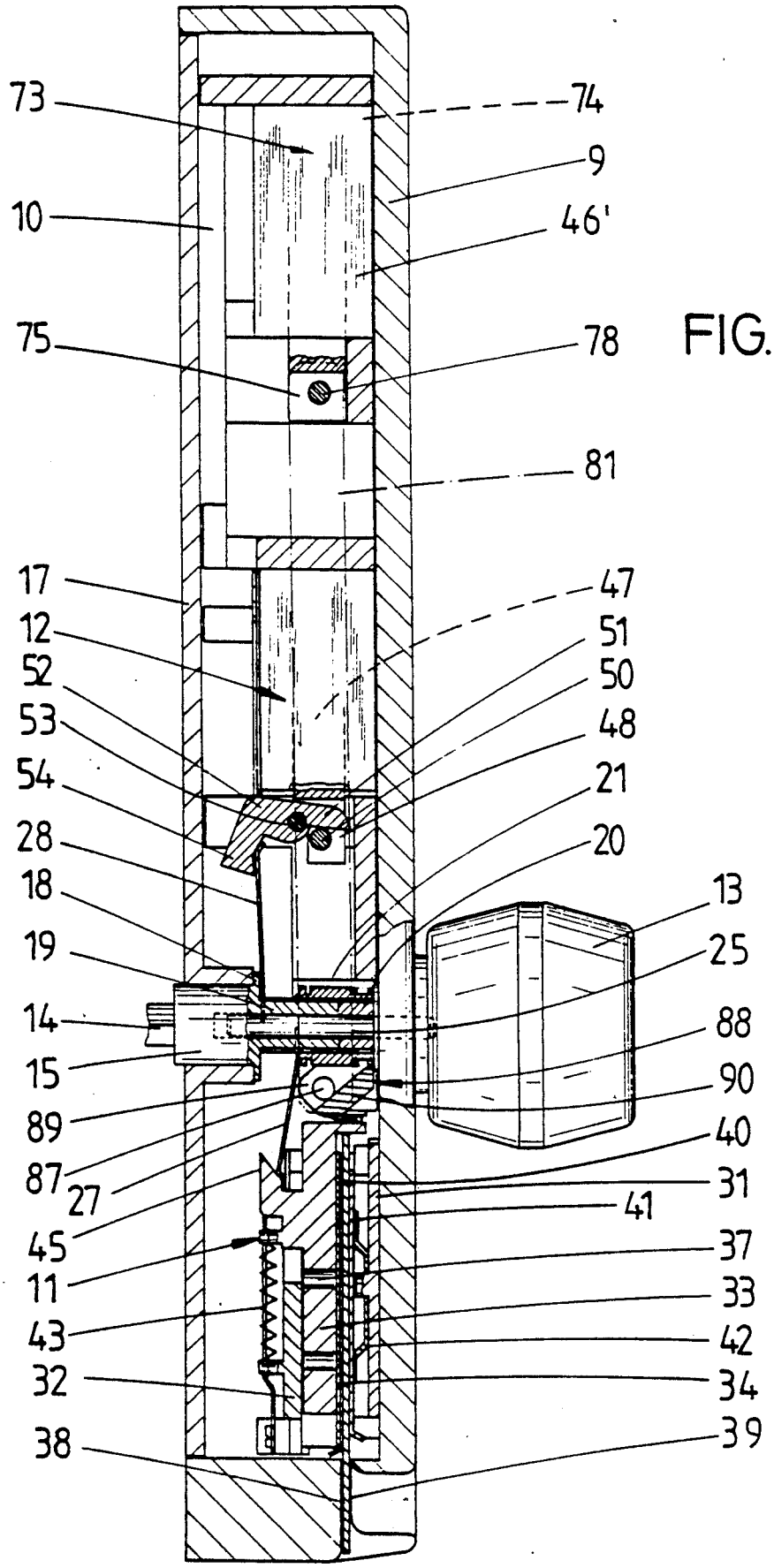
FIG. 15 is a showing, corresponding to FIG. 13, in which the key-actuatable device has brought about the coupling position by the insertion of a key card.

FIGS. 14 and 15 show the operating position of the armature 75 in which it has emerged from the position of adherence to the yoke 77 and extends by a larger amount out of the coil arrangement. This extending end of the armature 75 is traversed by a transverse pin 78 which engages into a hole 79 on the one end 80 of a transmission rod 81. A recess 83 is provided in the one side flank 82 of the housing 46' in order to receive the transmission rod 81. Straps 84, 85 connected to the housing 46' grip over the transmission rod 81 and secure its position with respect to the housing 46'. The other end 86 of the transmission rod 81 extends beyond the coupling bushing 21 and is connected via a pivot pin 87 to the free end of a single-arm pressure lever 88. This pressure lever 88, which swings around the pin 92 of the housing 46', is developed as a double layer, the two layers 89 being connected together by a bridge 90 which extends below the coupling bushing 21. The layers 89 are such a distance apart that they act on the fork-shaped end 29 of the actuating member 27.

The manner of operation of this hardware in accordance with the second embodiment corresponds substantially to that of the first embodiment. The electromagnetic device 70 is now replaced by the device 73. If the hardware is in the initial position shown in FIG. 14, then, by suitable remote control, the coil 74 can receive a current pulse via a capacitor. The armature moves together therewith into the position of attraction to the yoke 77 of the coil arrangement carrying along the transmission rod 81, which latter swings the pressure lever 88 into the position shown in FIGS. 12 and 13. The free end of the pressure lever 88 thus comes against the forked end 29 of the actuating member 27. In this position, the armature 75 is locked by the action of the permanent magnet 76. In addition to an upward movement of the transmission rod 81, the latter carries out, superimposed thereon, a certain swinging motion. The transmission rod 81 acts in this position on a microswitch 91 which produces the conductive connection to a light-emitting diode. In this way, it is indicated that the coupling produced by the key card has been eliminated. If, nevertheless, a key card is introduced in this position into the key-actuatable device 11 and displaces the slide 33, then, to be sure, the actuating member 27 is displaceable but only in such a manner that no coupling is produced between actuating knob 13 and push pin 14. Even if the key card 38 has been inserted and a coupling effected, the fork-shaped end 29 of the actuating member can be so displaced by the other electromagnetic device 23, with favorable acting force, that an existing coupling engagement is eliminated.

Figure 16:
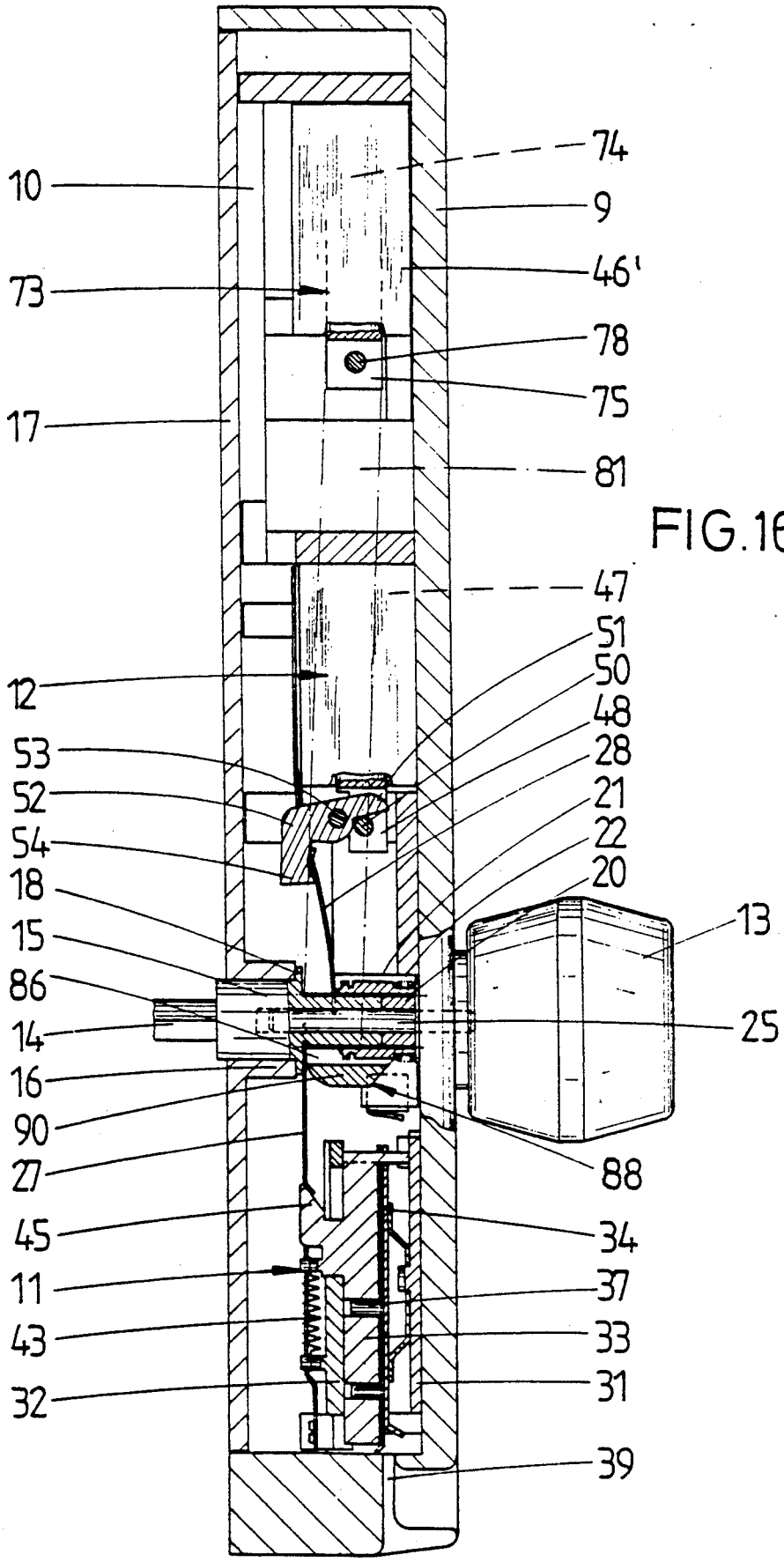
FIG. 16 is a longitudinal section corresponding to FIG. 15, but with the coupling controlled by an electromagnetic device.

The further functions of the hardware correspond to the embodiment described previously. Thus, for instance, FIG. 15 shows that the key-produced coupling is brought about by means of a key card 38. In FIG. 16, on the other hand, solely the one electromagnetic device 12 is in operation. By it, the actuating member 28 is so displaced that it also produces a coupling position. Access from the outside of the door can therefore take place at any time.

The blocking position of the pressure lever 88 is eliminated by oppositely directed current pulse conducted to the coil 74, hand in hand with an outward displacement of the armature 75 and the swinging of the pressure lever 88 into the position shown in FIG. 14. The end 80 of the transmission rod 81 moves away from the microswitch 91 so that this position can also be indicated by means of a light-emitting diode.

I claim:

1. Hardware, operable with a key card suitable for doors comprising a coupling, an electromagnetic device, an actuating knob, and a push pin which is couplable to the actuating nob by insertion of a key-card into the hardware; and wherein the coupling is mechanically connected to the knob and actuatable also by means of the electromagnetic device; and the electromagnetic device further comprises an electrically actuatable coil for reversibly displacing the coupling along said pin to effect connection with the knob;

a source of electric power having a reversibly poled output voltage for energizing said coil, a direction of displacement of said coupling corresponding to a sense of a poling of the voltage of said source; and means for maintaining a displacement of said coupling upon a termination of the voltage of said source, a displacement of said coupling in a first direction providing for a connection of said coupling with said knob, and a displacement of said coupling in a second direction opposite said first direction providing for a separation of said coupling from said knob.

2. Hardware, according to claim 1, further comprising a second electromagnetic device; and wherein both said electromagnetic devices operate in opposite directions and are individually controllable, one of said electromagnetic devices replaces the key-card-produced coupling, and the other of said electromagnetic devices eliminates the key-card-produced coupling.

3. Hardware, according to claim 1, wherein said coupling comprises a toothed bushing and a coupling bushing, each of said bushings having teeth engaging with the teeth of the other bushing, said coupling bushing being displaceable along said toothed bushing with spring loading; and said electromagnetic device acts on said coupling bushing and brings it by axial displacement into or out of an engagement position with the teeth of said toothed bushing on the actuating-knob side of the hardware.

4. Hardware, according to claim 3, further comprising a key-actuatable device and a first actuating member coupled thereto, a second actuating member coupled to said electromagnetic device; and wherein said coupling bushing has an annular collar on which said actuating members of said key-actuatable device and said electromagnetic device act.

5. Hardware, according to claim 4, wherein said actuating members are formed as leaf-spring tongues having free fork-shaped ends which engage the annular collar.

6. Hardware, according to claim 4, wherein the key-actuatable device is a magnetic card lock.

7. Hardware, according to claim 1, further comprising a key-actuatable device and a first actuating member coupled thereto, a second actuating member coupled to said electromagnetic device; and wherein said electromagnetic device comprises a longitudinally displaceable armature, said coil surrounding the armature; and a swingably mounted bell-crank lever having a free angle arm; and wherein said armature cooperates with one end of said swingably mounted bell-crank lever, a free angle arm of which acts on one of said actuating members.

8. Hardware, according to claim 7, wherein said electromagnetic device further comprises a yoke and a permanent magnet which is magnetically coupled to the yoke and said armature; and the end of said armature facing away from said bell-crank lever is displaceable within said yoke.

9. Hardware, according to claim 7, wherein said electromagnetic device further comprises a capacitor and a pole-reversal switch, said power source serving to change the capacitor; and wherein said coil is connected for its energization via the pole-reversal switch to the capacitor.

10. Hardware, according to claim 1, further comprising a key-actuatable device and a first actuating member coupled thereto, a second actuating member coupled to said electromagnetic device; and wherein said electromagnetic device further comprises a feeler for electrically interrogating a position of said second actuating members coupled to said electromagnetic device.

11. Hardware, according to claim 1, further comprising a time-switch device which, within a predetermined period of time, terminates an engaged position of said coupling by activating said electromagnetic device.

12. Hardware, according to claim 1, further comprising a key-actuatable device and a first actuating member coupled thereto, a second actuating member coupled to said electromagnetic device; and a second electromagnetic device which acts on said first actuating member which is coupled with said keyactuatable device.

13. Hardware, according to claim 12, wherein said second electromagnetic device comprises a coil arrangement with an armature which acts directly on said first actuating member.

14. Hardware, according to claim 12, wherein the push pin extends along an axis of said actuating knob to a side of said hardware opposite said actuating knob; and said hardware further comprises a transmission rod and a single-arm push lever which is mechanically connected to the transmission rod; and wherein an axis of said first mentioned electromagnetic device extends in a direction between said push pin and said second electromagnetic device;

said second electromagnetic device comprises a further coil and an armature to be acted upon magnetically by the further coil, the armature and the further coil being oriented in an axial extension of said first electromagnetic device, and in a direction facing away from said push pin;

the armature of said second electromagnetic device is pivotally connected to a first end of said transmission rod, a second end of said rod acting on said single-arm push lever for controlling the push lever into a region of movement of said first actuating member coupled to said key-actuatable device.

15. Hardware, according to claim 14, wherein said coupling comprises a toothed bushing and a coupling bushing, each of said bushings having teeth engaging with the teeth of the other bushing, said coupling bushing being displaceable along said toothed bushing; and said push lever is formed with two layers, there being a bridge which connects the two layers and extends closely below said coupling bushing.

16. Hardware, according to claim 13, further comprising a housing which receives said first-mentioned electromagnetic device and includes an elongated section; and wherein said armature of said second electromagnetic device is disposed in the elongated section.

17. Hardware, according to claim 14, further comprising a housing enclosing each of said electromagnetic devices; and wherein said transmission rod extends along a side flank of said housing.

* * * * *